United States Patent [19]

Simmons

[11] 3,993,418

[45] Nov. 23, 1976

[54] FLUID-PRESSURE OPERATED ACTUATOR WITH FOLLOW-UP TRANSMISSION

[75] Inventor: John Richard Simmons, Wolverhamton, England

[73] Assignee: Lucas Industries Limited, Birmingham, England

[22] Filed: July 21, 1975

[21] Appl. No.: 597,593

[30] Foreign Application Priority Data

July 30, 1974 United Kingdom ..... 33515/74

[52] U.S. Cl. ..... 418/206; 418/270; 91/380; 91/382

[51] Int. Cl.[2] ..... F15B 9/10; F01C 1/18; F01C 21/00

[58] Field of Search ..... 418/181, 205, 206, 270; 91/380, 382, 368, 381

[56] References Cited

UNITED STATES PATENTS

| | | | |
|---|---|---|---|
| 528,183 | 10/1894 | Schleicher | 91/380 |
| 742,070 | 10/1903 | Saylor | 91/382 |
| 1,086,464 | 2/1914 | Robinson | 91/382 |
| 2,453,651 | 11/1948 | Mock | 91/368 |
| 2,863,422 | 12/1958 | Mercier et al. | 91/380 |
| 2,949,891 | 8/1960 | Shube | 418/206 |

*Primary Examiner*—John J. Vrablik
*Attorney, Agent, or Firm*—Andrus, Sceales, Starke & Sawall

[57] ABSTRACT

A fluid-pressure operated actuator arrangement has a double-acting actuator device and a control valve. A three-element differential mechanism has two of its elements respectively drivingly connected to the control valve and the actuator device, and a third element resiliently coupled to an input lever. The input lever is frictionally restrained against movement. Relative movement between the lever and the third element, induced as a result of jamming the control valve, brakes the third element, increasing a torque which can be applied by the actuator device to the valve.

10 Claims, 2 Drawing Figures

FLUID-PRESSURE OPERATED ACTUATOR WITH FOLLOW-UP TRANSMISSION

This invention relates to fluid-pressure operated actuator arrangements.

According to the invention a fluid-pressure operated actuator arrangement includes a double-acting pressure-operated actuator device, a valve operable to apply a fluid pressure to said device to drive the latter in respective opposite directions, and a control linkage for said valve, said control linkage comprising a differential transmission arrangement having a first element drivingly connected to said valve, a second element drivingly connected to said actuator device and a third element, an input member, means for resiliently coupling said input member to said third element, means restraining free movement of said input member, and a braking device, operable only when said third element urges said input member against said restraining means, for preventing movement of said third element.

In a preferred embodiment of the invention said differential transmission arrangement comprises a gear train in which said first element is provided by a ring gear, said second element is provided by a sun gear, and said third element comprises a planet gear and its carrier.

An example of the invention will now be described with reference to the accompanying drawings in which.

Figure 1:
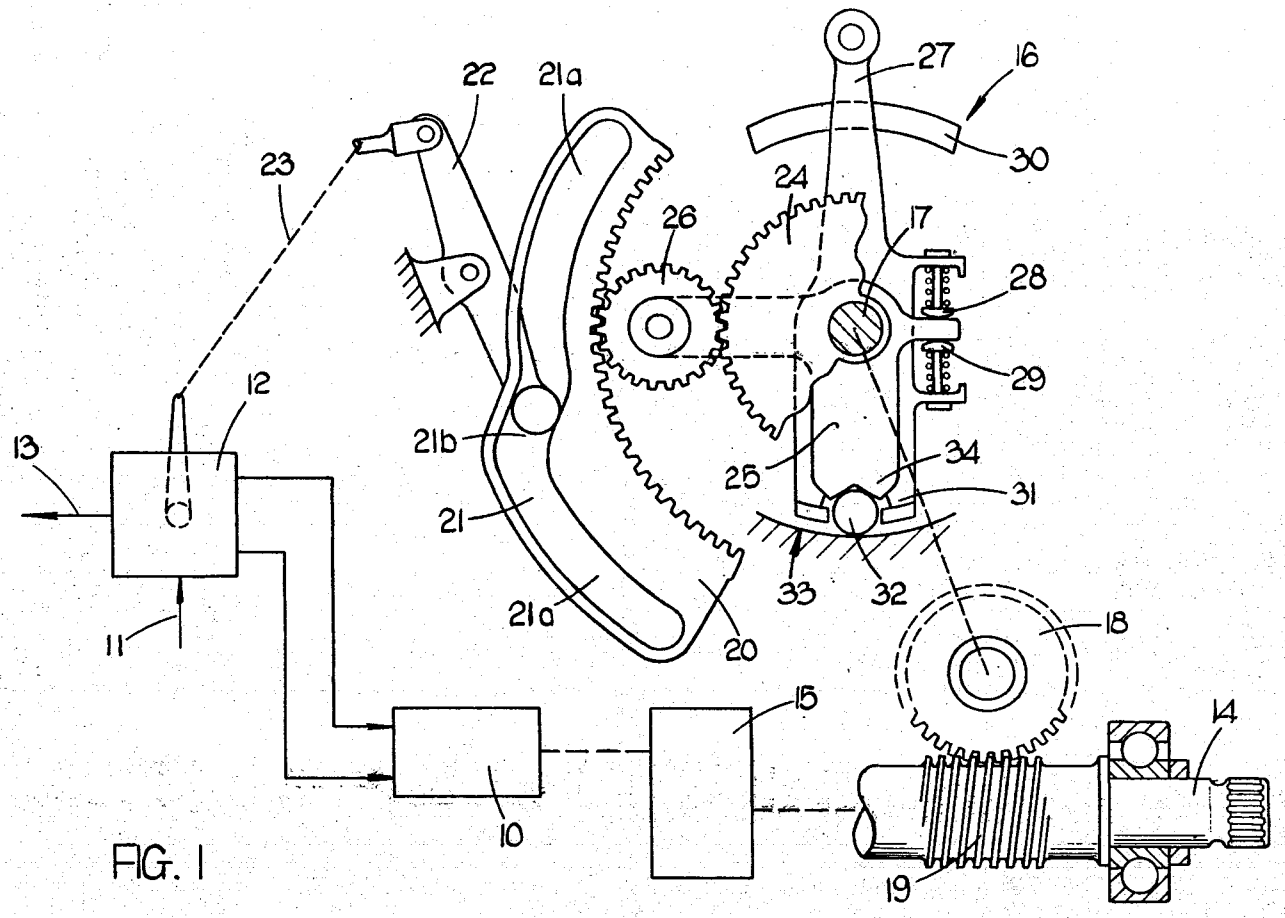
FIG. 1 shows, somewhat diagrammatically an actuator arrangement.

The arrangement includes an actuator device 10 comprising a Roots-type blower arranged to act as a motor. Air under pressure is supplied from an input conduit 11 to the actuator device under control of a valve 12. Valve 12 has a central, shut position from which it is movable in either direction to supply air to a selected one of the sides of actuator device 10, the other side of device 10 being connected via the valve 12 to an outlet conduit 13.

The device 10 drives an output shaft 14 via a reduction gear 15. Valve 12 is operated by a control linkage 16 in the form of a differential transmission arrangement.

Linkage 16 has a shaft 17 to which is secured a wheel 18 drivingly engaged with a worm 19 on the output shaft 14. Mounted for free pivotal movement about shaft 17 is a quadrant 20 having internal gear teeth. Quadrant 20 is formed with a cam track 21 in which one end of a cam-follower lever 22 is engaged. The cam track 21 has two portions **21*a* which are arcuate about the centre of the shaft 17, and a central portion 21*b* which imparts movement to the lever 22. Lever 22 normally coacts with the portion 21*b*, portions 21*a* being provided to limit movement of lever 22. The other end of lever 22 is coupled via a rod 23 to the valve 12. Secured to the shaft 17 is a sun gear 24. A planet wheel carrier 25 is mounted for free pivotal movement about the shaft 17 and a planet wheel 26 on the carrier 25 meshes with the quadrant 20 and sun gear 24**.

An input lever 27 can drive the carrier 25 in opposite directions by means of respective spring-loaded plungers 28, 29. It is arranged that input lever 27 has a stiffness which restrains its free movement about the shaft 17. This stiffness is indicated notionally in the drawing as a plate 30 which the lever 27 frictionally engages. It will be appreciated, however, that this stiffness could be present in an external drive linkage by means of which lever 27 is, in use, moved. It is arranged that the torque required to overcome this stiffness of lever 27 is greater than that required to compress either of the springs associated with the plungers 28, 29. Lever 27 is provided with a forked end 31 which locates a ball 32. Ball 32 can run on a fixed arcuate track 33. Ball 32 also engages a V-slot 34 in the planet wheel carrier 25.

In use, assume valve 12 is initially in its central, shut position, and that the actuator device 10 is consequently stationary.

Subsequent movement of lever 27 is an anti-clockwise direction (as shown in the drawing) urges carrier 25 anti-clockwise, the bias supplied to plungers 28, 29 is such that the stiffness in the gear train does not compress their associated springs. Since the actuator device 10 is stationary, sun gear 24 does not move and movement of the carrier 25 is transmitted via the planet wheel 26 to the quadrant 20. The resultant anti-clockwise movement of quadrant 20 moves the valve 12, via lever 22 and rod 23, anti-clockwise from its shut position. Actuator device 10 rotates in a direction which causes the wheel 18 to drive shaft 17 and sun gear 24 anti-clockwise. In normal circumstances the frictional engagement of lever 27 with plate 30 maintains lever 27 stationary and also, via spring-loaded plungers 28, 29, maintains carrier 25 stationary. Anti-clockwise rotation of sun gear 24 thus rotates quadrant 20 clockwise to return valve 12 to its initial, shut position.

Clockwise movement of lever 27 similarly moves valve 12 to cause device 10 to rotate in the opposite direction valve 12 being returned to its shut position on completion of the required movement of device 10.

Figure 2:
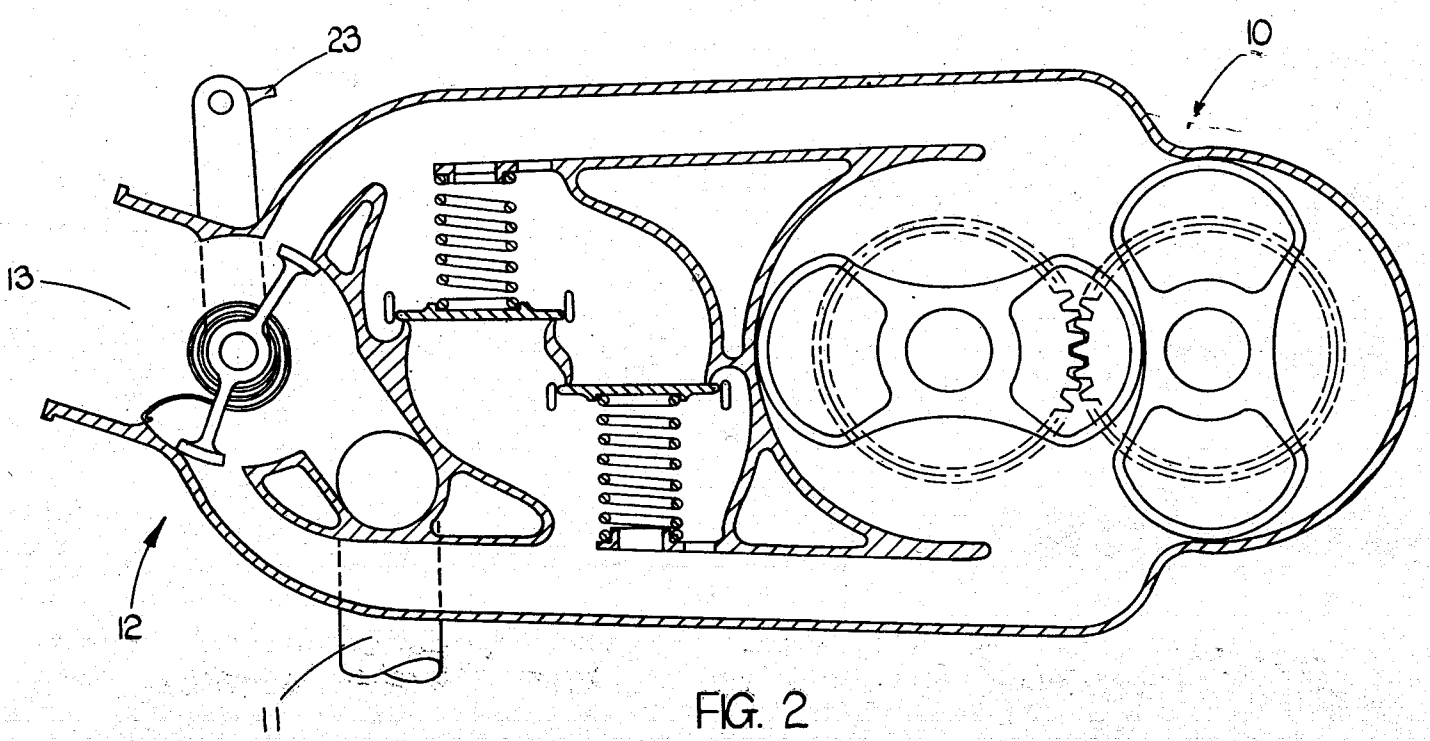
FIG. 2 shows a detail of FIG. 1.

As will be seen from FIG. 2, valve 12 has vane-type control members. If foreign matter becomes trapped between the valve vanes and the edges of the valve ports valve 12 will jam. If jamming occurs while the valve 12 is being driven back to its shut position, the quadrant 20 becomes stationary, and thereby acts as a reaction member. Rotation of sun gear 24 will, in these circumstances, urge carrier 25 to rotate about shaft 17. As previously indicated, the frictional engagement between lever 27 and plate 30 is sufficient to overcome the bias applied to the plungers 28, 29 and carrier 25 therefore rotates relative to lever 27. This rotation causes ball 32 to be urged into frictional contact with track 33, braking both carrier 25 and lever 27. The whole of the torque applied to shaft 17 is thereby available to rotate quadrant 20 to overcome the jamming of valve 12. With valve 12 jammed, this torque would otherwise be expended in driving lever 27 against its frictional engagement with plate 30.

Should valve 12 jam prior to movement of lever 27, plunger 28 or plunger 29 is depressed so that an increased force may be transmitted from lever 27 to carrier 25. This movement of lever 27 relative to carrier 25 does not cause ball 32 to have a braking action, but to skid round the surface of track 33. Movement between carrier 25 and sun gear 24 causes this increased force to be applied to the quadrant 20 to free the valve 12.

I claim:

1. A fluid-pressure operated actuator with follow-up transmission, including a double-acting pressure-operated actuator device, a valve operable to apply a fluid pressure to said device to drive the latter in respective opposite directions, and a control linkage for said valve, said control linkage comprising a differential transmission arrangement having a first element drivingly connected to said valve, a second element drivingly connected to said actuator device and a third element drivingly cooperating with said first and second elements, the velocity of any one of said elements being dependent on the relative velocities of the other two elements, an input member, means for resiliently coupling said input member to said third element, means restraining free movement of said input member and a braking means, operable only when arrest of said first element causes said third element to apply a driving force to said input member, for preventing movement of said third element.

2. An actuator as claimed in claim 1 in which said differential transmission arrangement comprises a gear train in which said first element is provided by a ring gear, said second element is provided by a sun gear, and said third element comprises a planet gear and its carrier.

3. An actuator as claimed in claim 1 which includes a cam coupled to said first element for movement therewith and a cam follower engaging said cam and coacting with said valve.

4. An actuator as claimed in claim 3 in which said cam includes a cam track having a central portion which is effective to impart movement to said follower, and two portions adjacent said central portion, said two portions being ineffective to impart movement to said follower.

5. An actuator as claimed in claim 1 in which said resilient coupling means comprises a pair of biasing means coacting with said input member and said third element, for urging the latter in respective opposite directions relative to the input member, said restraining means being such that a force required to be applied by said third element to urge said input member against said restraining means is sufficient to overcome said biasing means.

6. An actuator as claimed in claim 5 in which said biasing means comprise spring-loaded plungers.

7. An actuator as claimed in claim 1 in which said braking device comprises a relatively fixed surface and a part, responsive to relative movement between said input member and said third element, for engaging said fixed surface.

8. An actuator as claimed in claim 1 in which said valve includes vane-type control members.

9. An actuator as claimed in claim 1 in which said actuator is a rotary actuator.

10. An actuator as claimed in claim 9 in which said actuator is a Roots-type machine.

* * * * *